US007661861B2

(12) United States Patent
Suzuki

(10) Patent No.: US 7,661,861 B2
(45) Date of Patent: Feb. 16, 2010

(54) VEHICLE HEADLAMP

(75) Inventor: Yasufumi Suzuki, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 246 days.

(21) Appl. No.: 11/882,891

(22) Filed: Aug. 6, 2007

(65) Prior Publication Data

US 2008/0043486 A1 Feb. 21, 2008

(30) Foreign Application Priority Data

Aug. 10, 2006 (JP) ..... 2006-218019

(51) Int. Cl.
*F21V 11/16* (2006.01)

(52) U.S. Cl. ..... 362/539; 362/538

(58) Field of Classification Search ..... 362/539, 362/538, 263, 351, 509, 512
See application file for complete search history.

(56) References Cited

U.S. PATENT DOCUMENTS 6,623,149 B2 * 9/2003 Leleve ..... 362/539
6,742,920 B2 * 6/2004 Takada et al. ..... 362/539
2003/0223246 A1 * 12/2003 Albou ..... 362/539

FOREIGN PATENT DOCUMENTS

JP 6-15206 U 2/1994

* cited by examiner

*Primary Examiner*—Bao Q Truong
(74) *Attorney, Agent, or Firm*—Foley & Lardner LLP

(57) ABSTRACT

A vehicle headlamp includes a shade having a diagonal edge, an upper horizontal edge, and a lower horizontal edge. The intersection of the diagonal edge and the upper horizontal edge is horizontally deviated from a first reference position, i.e., an elbow point of a conventional shade, or a vertical reference axis to an opposite side with respect to the intersection of the diagonal edge and the lower horizontal edge.

6 Claims, 7 Drawing Sheets

VEHICLE HEADLAMP

CROSS-REFERENCE TO RELATED APPLICATIONS

The present application claims priority and incorporates by reference the entire contents of Japanese priority document, 2006-218019 filed in Japan on Aug. 10, 2006.

BACKGROUND OF THE INVENTION

1. Field of the Invention

The present invention relates to a vehicle headlamp.

2. Description of the Related Art

Projector-type vehicle headlamps have been available. For example, Japanese Utility Model Application Laid-Open No. H6-15206 discloses a conventional vehicle headlamp. The conventional vehicle headlamp is explained below. The conventional vehicle headlamp includes a light source, a reflector that reflects light from the light source, a projection lens that projects the reflected light from the light source forward, and a shade that blocks a part of the reflected light directed toward the projection lens from the reflector to form a light-distribution pattern having a cut-off line.

When the light source is turned on, light from the light source is reflected by the reflector toward the projection lens, and a part of the reflected light is blocked by the shade. The remaining light is irradiated from the projection lens to the front of a vehicle in a light-distribution pattern having a cut-off line.

In the conventional vehicle headlamp, as shown in FIG. 4, an elbow point E10, which is an intersection of a diagonal edge 110 and an upper horizontal edge 130 of a shade 500, is located on a vertical reference axis VU-VD. As shown in FIG. 6, an elbow point E20, which is an intersection of a diagonal cut-off line CL10 and a lower horizontal cut-off line CL30 of a passing-light-distribution pattern P0, is located on the vertical reference axis VU-VD. Accordingly, in the conventional vehicle headlamp, as shown in FIG. 8, lighting (light/dark) difference substantially of a left-right reversal or inverted Z-shape (hereinafter, "Z-shape") appears in a far area (eye point in a circle of two-dot chain line in FIG. 8) IP of an own driving lane 15 which a driver looks at. Therefore, there is a problem in far visibility due to a dark spot in the Z-shape, and there are a sense of incompatibility and trouble due to the Z-shaped lighting difference.

SUMMARY OF THE INVENTION

It is an object of the present invention to at least partially solve the problems in the conventional technology.

According to an aspect of the present invention, a vehicle headlamp for illuminating front of a vehicle with light in a light-distribution pattern, includes a light source, a reflector that reflects light from the light source, a projection lens that projects reflected light from the reflector, and a shade that blocks part of the reflected light directed toward the projection lens from the reflector to form the light-distribution pattern having cut-off lines. The cut-off lines are formed based on a vertical reference axis and a horizontal reference axis, and include a diagonal cut-off line, a first horizontal cut-off line extending horizontally from a first end of the diagonal cut-off line, and a second horizontal cut-off line extending horizontally from a second end of the diagonal cut-off line. The shade includes a diagonal edge that forms the diagonal cut-off line, a second horizontal edge that forms the first horizontal cut-off line, and a first horizontal edge that forms the second horizontal cut-off line. An intersection of the diagonal edge and the first horizontal edge is horizontally deviated from a first reference position on the vertical reference axis in a direction opposite to an intersection of the diagonal edge and the second horizontal edge.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
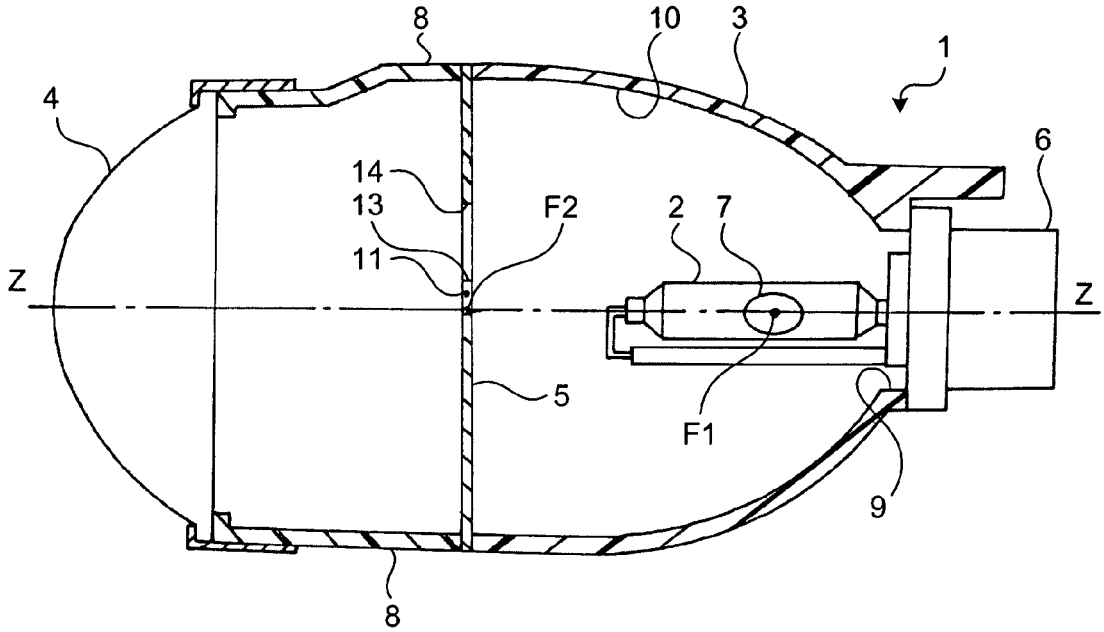
FIG. 1 is a longitudinal section (vertical section) of a lamp unit of a vehicle headlamp according to an embodiment the present invention.

Exemplary embodiments of the present invention are explained below in detail with reference to the accompanying drawings. Note that in the drawings, reference letters "VU-VD" denotes a vertical line on a screen and a vertical reference axis. Reference letters "HL-HR" denotes a horizontal line on the screen and a horizontal reference axis. In the following, "upward", "downward", "forward", "backward", "left", and "right" indicate directions with respect to a vehicle on which a vehicle headlamp according to the embodiments is to be mounted.

A configuration of a vehicle headlamp 1 according to an embodiment of the present invention is explained below. The vehicle headlamp 1 can be, for example, a projector-type headlamp which is configured to be mounted on the front of an automobile (vehicle), on the left and right sides. The vehicle headlamp is explained herein as being applied to the right-hand traffic.

Figure 2:
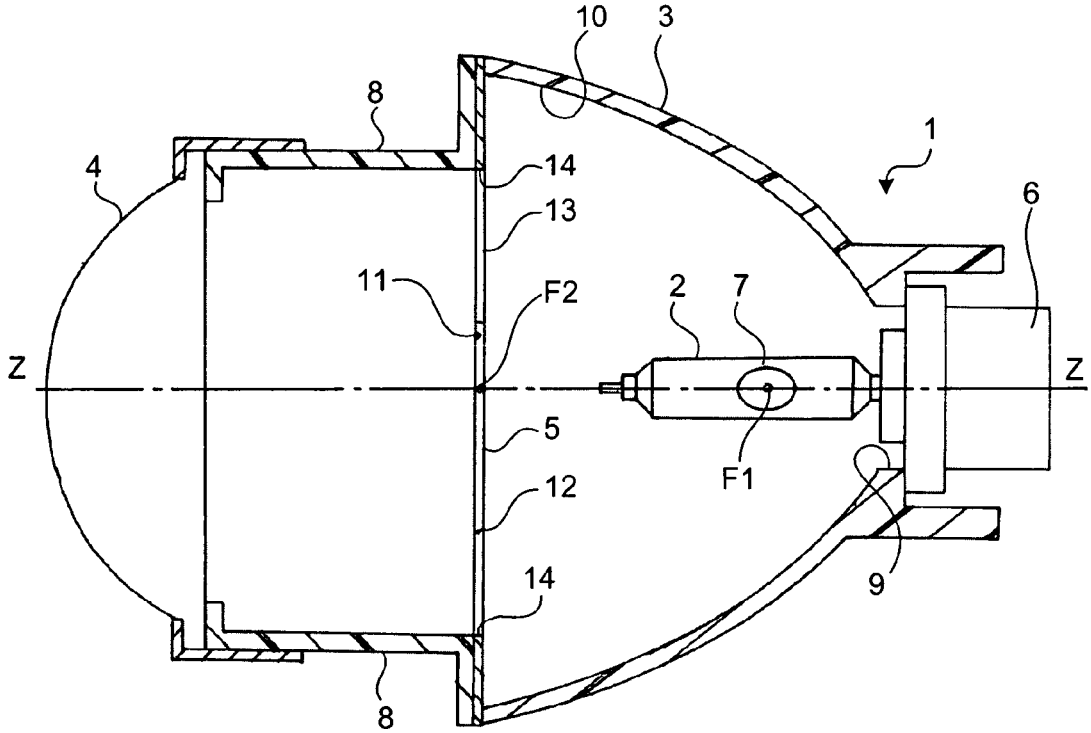
FIG. 2 is a cross section (horizontal section) of the lamp unit.

The vehicle headlamp 1 includes, as shown in FIGS. 1 and 2, a discharge lamp 2 as a light source, a reflector 3, a projection lens 4 such as a condenser lens, and convex lens, a shade 5, a frame member 8, a lamp housing (not shown), and a lamp lens such as a transparent outer lens (not shown).

The discharge lamp 2, the reflector 3, the projection lens 4, the shade 5, and the frame member 8 constitute a lamp unit. The lamp unit is arranged, for example, through an optical-axis adjusting mechanism (not shown), in a lamp chamber (not shown) defined by the lamp housing and the lamp lens.

Examples of the discharge lamp 2 include, but not limited to, high-pressure metal-vapor discharge lamps such as metal halide lamps and high intensity discharge (HID) lamps. The discharge lamp 2 is detachably fitted to the reflector 3 via a socket mechanism 6. The discharge lamp 2 includes a light-emitting unit 7. The light source can be a tungsten halogen lamp or an incandescent lamp other than the discharge lamp 2.

The reflector 3 is fixed and held by the frame member 8. The reflector 3 is formed in a hollow concave shape, with the front (irradiation side of the light of the vehicle headlamp 1) being open and the back being closed. A circular through hole 9 for inserting the discharge lamp 2 is provided in the middle of a back closed portion of the reflector 3.

Aluminum evaporation or silver coating is applied to an inner concave of the reflector 3 to form a reflecting surface 10. The reflecting surface 10 reflects the light from the light-emitting unit 7 of the discharge lamp 2 toward the shade 5 and the projection lens 4. The reflecting surface 10 is elliptical or elliptical free-form (non-uniform rational B-splines (NURBS) curved surface) with the vertical section shown in FIG. 1 forms an ellipsoid, and the horizontal section shown in FIG. 2 forms a paraboloid or a deformed paraboloid. Therefore, the reflecting surface 10 has a first focal point F1, a second focal point (focal line on the horizontal section) F2, and a rotation axis, that is, an optical axis Z-Z. For a more complete description of the NURBS surface, reference may be had to "Mathematical Elements for Computer Graphics" by David F. Rogers, J. Alan Adams, which is incorporated herein by reference.

The projection lens 4 can be any convex lens which is an aspherical lens. The front side of the projection lens 4 forms a convex aspheric surface, and the rear side thereof forms a flat (plane) aspheric surface. The projection lens 4 is fixed and held by the frame member 8. The projection lens 4 has a lens focal point (meridional image surface, which is a focal plane on an object space side) and an optical axis (not shown). The focal point of the projection lens 4 and the second focal point F2 of the reflecting surface 10 match each other (or substantially match each other). The optical axis of the projection lens 4 and the optical axis Z-Z of the reflecting surface 10 are deviated from each other horizontally. The optical axis of the projection lens 4 and the optical axis Z-Z of the reflecting surface 10 can match each other (or substantially match each other).

The shade 5 has a plate structure (in this example, a flat sheet-steel structure), whose manufacturing cost is inexpensive. The shade 5 has an opening 14. The shade 5 blocks a part of the reflected light directed toward the projection lens 4 from the reflecting surface 10 by a portion other than the opening 14, and allows the remaining reflected light to pass through the opening 14, to form a predetermined light-distribution pattern having cut-off lines CL1, CL2, and CL3, for example, a passing-light-distribution pattern P shown in FIG. 5.

Figure 5:
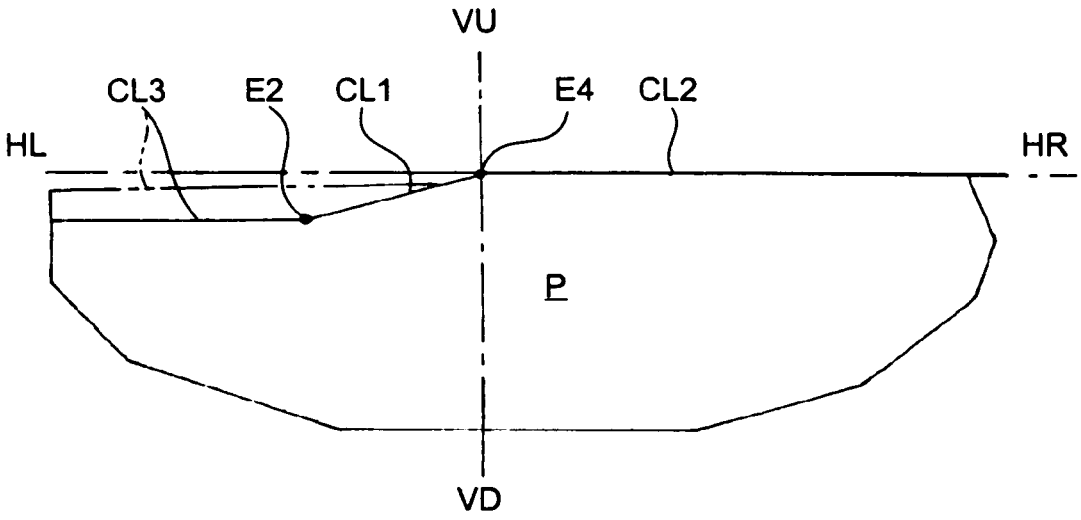
FIG. 5 is a schematic diagram for explaining a passing-light-distribution pattern according to the embodiment.

The cut-off lines of the passing-light-distribution pattern P are formed, as shown in FIG. 5, based on the vertical reference axis VU-VD and the horizontal reference axis HL-HR. The cut-off lines include a diagonal cut-off line CL1, an upper horizontal cut-off line CL2 extending horizontally from an upper end of the diagonal cut-off line CL1, and a lower horizontal cut-off line CL3 extending horizontally from a lower end of the diagonal cut-off line CL1.

Edges 11, 12, and 13 are provided at a lower end of the opening 14 of the shade 5 for forming the cut-off lines CL1, CL2, and CL3 of the passing-light-distribution pattern P, respectively. The edges 11, 12, and 13 are located along or near the lens focal point of the projection lens 4, or along or near the second focal point F2 of the reflecting surface 10. The shade 5 is fixed and held by the frame member 8.

Figure 3:
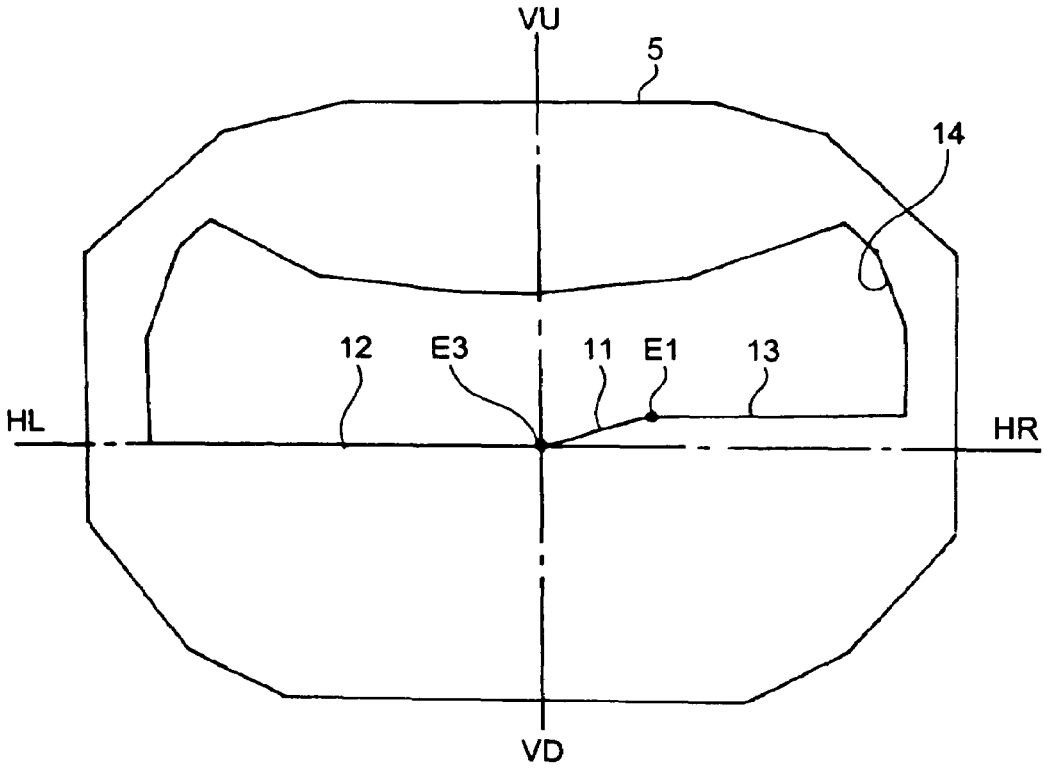
FIG. 3 is a back view of a shade according to the embodiment.

That is, as shown in FIG. 3, the shade 5 includes a diagonal edge 11 that forms the diagonal cut-off line CL1, a lower horizontal edge 12 that forms the upper horizontal cut-off line CL2, and an upper horizontal edge 13 that forms the lower horizontal cut-off line CL3.

Figure 4:
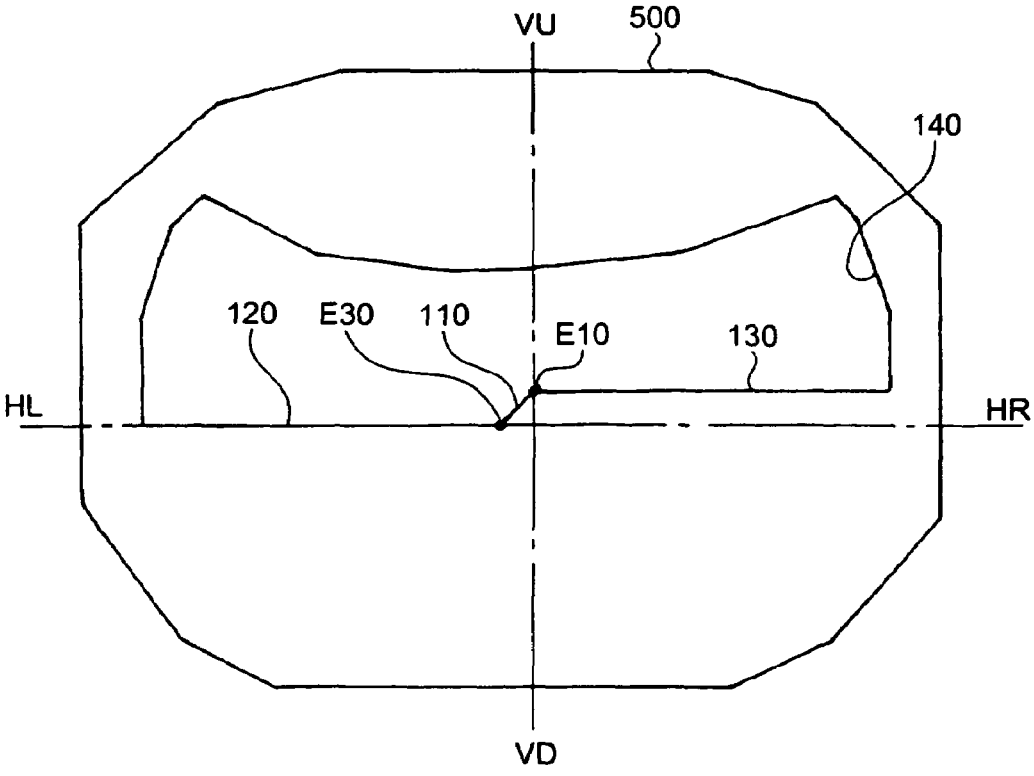
FIG.4 PRIOR ART
FIG. 4 is a back view of a shade of a conventional vehicle headlamp.

As shown in FIG. 3, an elbow point E1, which is an intersection of the diagonal edge 11 and the upper horizontal edge 13, is deviated horizontally from a first reference position (the elbow point E10 of the conventional vehicle headlamp shown in FIG. 4) or the vertical reference axis VU-VD to an opposite side (right side) with respect to an intersection E3 of the diagonal edge 11 and the lower horizontal edge 12.

As shown in FIG. 3, the diagonal edge 11 is inclined at an angle less than an angle at which a reference diagonal edge is inclined. The reference diagonal edge is the one obtained when the elbow point E1 (the intersection of the diagonal edge 11 and the upper horizontal edge 13) is located at the first reference position (the elbow point E10 of the conventional vehicle headlamp shown in FIG. 4) or the vertical reference axis VU-VD and the intersection E3 is located at a second reference position (an intersection E30 of the diagonal edge 110 and a lower horizontal edge 120 of the conventional vehicle headlamp shown in FIG. 4). Namely, the reference diagonal edge is the diagonal edge 110 of the conventional vehicle headlamp shown in FIG. 4.

Further, the intersection E3 (the intersection of the diagonal edge 11 and the lower horizontal edge 12) is deviated horizontally, as shown in FIG. 3, from the second reference position (the intersection E30) in the same direction as a deviation direction of the elbow point E1 (to the right), up to the vertical reference axis VU-VD at the maximum.

FIG. 3 is a back view of the shade 5. FIG. 4 is a back view of the shade 500. The shade 500 has an opening 140. The diagonal edge 110, the elbow point E10, and the intersection E30 of the shade 500 shown in FIG. 4 are designated as a reference diagonal edge, the first reference position, and the second reference position, respectively.

The operation of the vehicle headlamp 1 is explained below. When the discharge lamp 2 is turned on, light is emitted from the light-emitting unit 7 of the discharge lamp 2. The light is reflected by the reflecting surface 10 of the reflector 3 toward the shade 5 and the projection lens 4. A part of the reflected light is blocked by the portion of the shade 5 other than the opening 14, and the remaining light forms the passing-light-distribution pattern P having the cut-off lines shown in FIG. 5 (the diagonal cut-off line CL1, the upper horizontal cut-off line CL2, and the lower horizontal cut-off line CL3). The remaining reflected light passes through the opening 14 of the shade 5, travels toward the projection lens 4, passes through the projection lens 4, and projected (emitted or irradiated) to the front of the vehicle.

Figure 6:
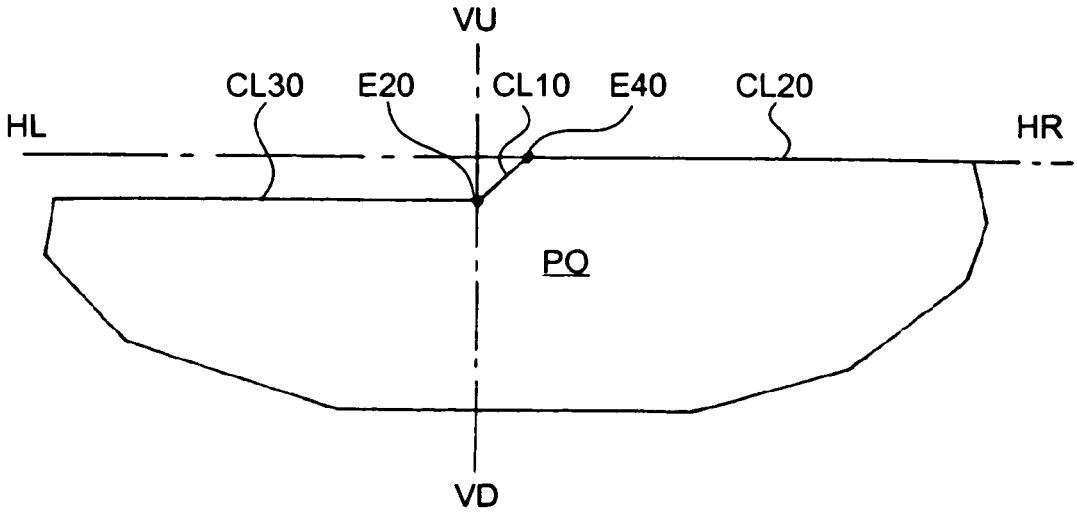
FIG.6 PRIOR ART
FIG. 6 is a schematic diagram for explaining a passing-light-distribution pattern of the conventional vehicle headlamp.
Figure 9:
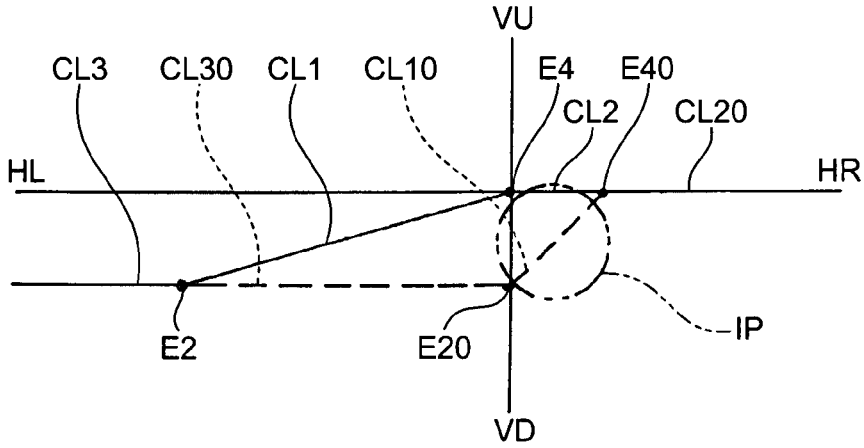
FIG. 9 is a schematic diagram for explaining a difference between cut-off lines of the passing-light-distribution pattern according to the embodiment and cut-off lines of the passing-light-distribution pattern of the conventional vehicle headlamp.

The elbow point E2, which is the intersection of the diagonal cut-off line CL1 and the lower horizontal cut-off line CL3 of the passing-light-distribution pattern P shown in FIG. 5, obtained by the vehicle headlamp 1 is deviated horizontally, as shown in FIG. 9, from the reference elbow point E20 or the vertical reference axis VU-VD in a reference passing-light-distribution pattern P0 shown in FIG. 6, to the opposite side (left side) with respect to an intersection E4 of the diagonal cut-off line CL1 and the upper horizontal cut-off line CL2. The reference passing-light-distribution pattern P0 is obtained by the conventional vehicle headlamp mentioned above.

The diagonal cut-off line CL1 of the passing-light-distribution pattern P shown in FIG. 5 is inclined at an angle less than an angle at which the reference diagonal cut-off line CL10 in the reference passing-light-distribution pattern P0 shown in FIG. 6 is inclined.

The intersection E4 is deviated horizontally, as shown in FIG. 9, from a reference intersection E40 in the same direction as the deviation direction of the elbow point E2, which is the intersection of the diagonal cut-off line CL1 and the lower horizontal cut-off line CL3 (to the left), up to the vertical reference axis VU-VD at the maximum. The intersection E4 is an intersection of the diagonal cut-off line CL1 and the upper horizontal cut-off line CL2 of the passing-light-distribution pattern P shown in FIG. 5 obtained by the vehicle headlamp 1. The reference intersection E40 is an intersection of the diagonal cut-off line CL10 and the upper horizontal cut-off line CL20 in the reference passing-light-distribution pattern P0 shown in FIG. 6, obtained by the conventional vehicle headlamp.

FIG. 5 is a schematic diagram for explaining the passing-light-distribution pattern P obtained by the vehicle headlamp 1. FIG. 6 is a schematic diagram for explaining the reference passing-light-distribution pattern P0 obtained by the conventional vehicle headlamp. The passing-light-distribution pattern P0 obtained by the conventional vehicle headlamp shown in FIG. 6, and the diagonal cut-off line CL10, the elbow point E20, and the intersection E40 of the passing-light-distribution pattern P0 are designated as the reference passing-light-distribution pattern, reference diagonal cut-off line, reference elbow point, and reference intersection, respectively.

The vehicle headlamp 1 has the above configuration and operation, and an effect thereof is explained below.

Figure 7:
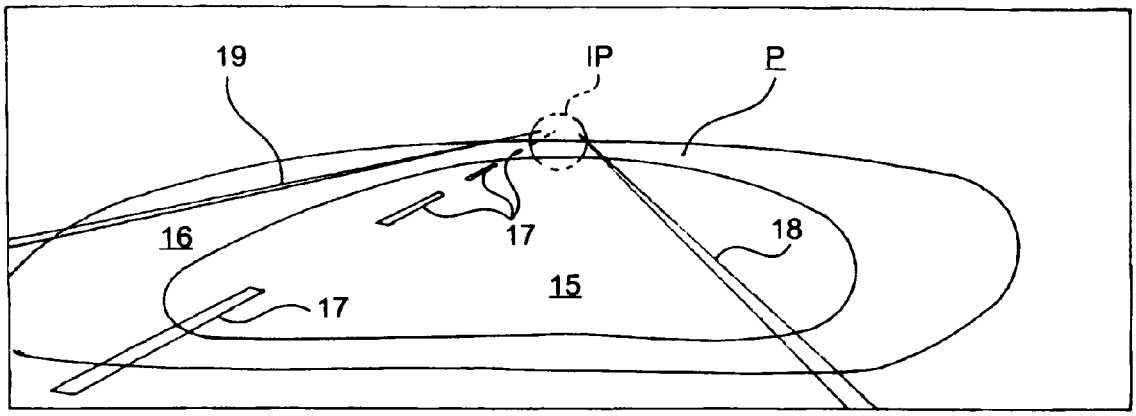
FIG. 7 is a schematic diagram for explaining brightness on road surface (surface light intensity) of the passing-light-distribution pattern according to the embodiment.

In the vehicle headlamp 1, as shown in FIG. 9, the elbow point E2, which is the intersection of the diagonal cut-off line CL1 and the lower horizontal cut-off line CL3 of the passing-light-distribution pattern P is deviated horizontally from the reference elbow point E20 or the vertical reference axis VU-VD to the opposite side (left side) with respect to the intersection E4 of the diagonal cut-off line CL1 and the upper horizontal cut-off line CL2. Therefore, as shown in FIG. 7, a horizontal lighting (light/dark) difference appears in a far area (eye point in a circle of two-dot chain line in FIG. 7) IP of the own driving lane 15 which a driver looks at. Therefore, the far visibility is improved as compared to the Z-shaped lighting difference having a dark spot in the area IP shown in FIG. 8, and the sense of incompatibility and trouble can be reduced as compared to the Z-shaped lighting difference. Accordingly, the vehicle headlamp 1 can contribute to traffic safety.

In the vehicle headlamp 1, as shown in FIG. 9, the diagonal cut-off line CL1 of the passing-light-distribution pattern P is inclined at an angle less than an angle at which the reference diagonal cut-off line CL10 is inclined. As a result, as shown in FIG. 7, the lighting (light/dark) difference in the area IP becomes milder, which further improves the far visibility and reduces the sense of incompatibility and trouble.

In the vehicle headlamp 1, as shown in FIG. 9, the intersection E4 of the diagonal cut-off line CL1 and the upper horizontal cut-off line CL2 of the passing-light-distribution pattern P is deviated horizontally from the reference intersection E40 in the same direction as the deviation direction of the elbow point E2, which is the intersection of the diagonal cut-off line CL1 and the lower horizontal cut-off line CL3 (to the left), up to the vertical reference axis VU-VD at the maximum. Accordingly, the intersection E4 of the diagonal cut-off line CL1 and the upper horizontal cut-off line CL2 of the passing-light-distribution pattern P does not enter an opposing lane 16 (the left side of the vertical reference axis VU-VD in FIG. 9), and the vehicle headlamp 1 can prevent glare to oncoming drivers.

That is, as shown in FIG. 9, the diagonal cut-off line CL10 of the passing-light-distribution pattern obtained by the conventional vehicle headlamp passes substantially the center of the area IP, whereas the diagonal cut-off line CL1 of the passing-light-distribution pattern obtained by the vehicle headlamp 1 does not pass through the area IP. Therefore, the vehicle headlamp 1 can achieve the effect described above.

Figure 8:
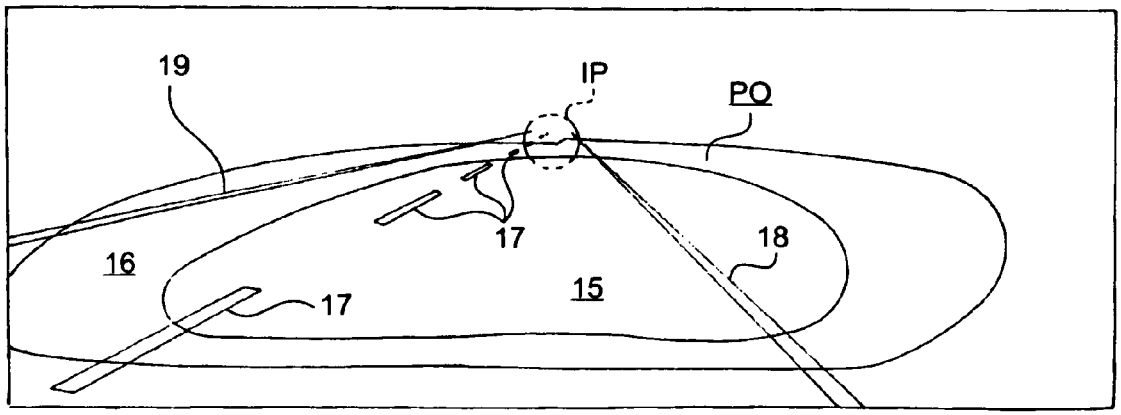
FIG.8 PRIOR ART
FIG. 8 is a schematic diagram for explaining brightness on road surface (surface light intensity) of the passing-light-distribution pattern of the conventional vehicle headlamp.

FIG. 7 is a schematic diagram for explaining brightness on road surface (surface light intensity) of the passing-light-distribution pattern P obtained by the vehicle headlamp 1. FIG. 8 is a schematic diagram for explaining brightness on road surface (surface light intensity) of the passing-light-distribution pattern P0 obtained by the conventional vehicle headlamp. In FIGS. 7 and 8, road is divided by a centerline 17 into the own driving lane 15 and the opposing lane 16 with a shoulder 18 on the own driving lane 15 side and a shoulder 19 on the opposing lane 16 side.

In the vehicle headlamp 1, an angle at the elbow point E1, which is the intersection of the diagonal edge 11 and the upper horizontal edge 13 of the shade 5, and an angle at the intersection E3 of the diagonal edge 11 and the lower horizontal edge 12 of the shade 5 are obtuse. Therefore, the shade 5 can be manufactured reliably and easily without being chipped off at the elbow point E1 and the intersection E3.

Figure 10:
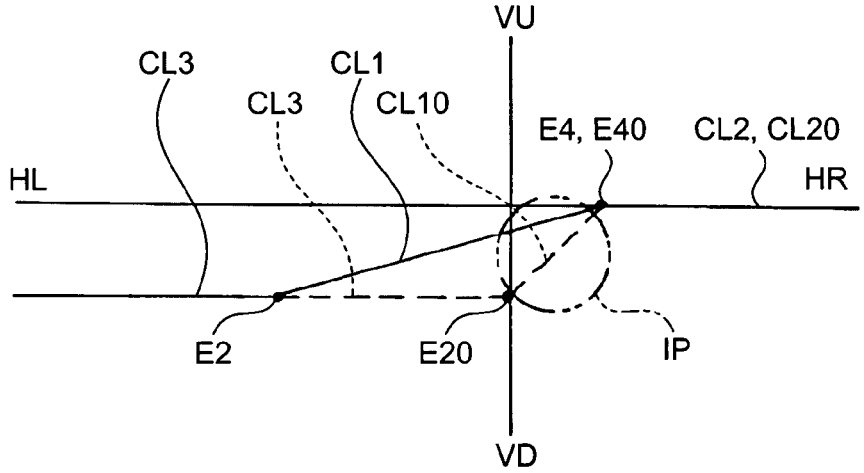
FIG. 10 is a schematic diagram for explaining a difference between cut-off lines of a passing-light-distribution pattern according to a first modification of the embodiment and the cut-off lines of the passing-light-distribution pattern of the conventional vehicle headlamp.
Figure 12:
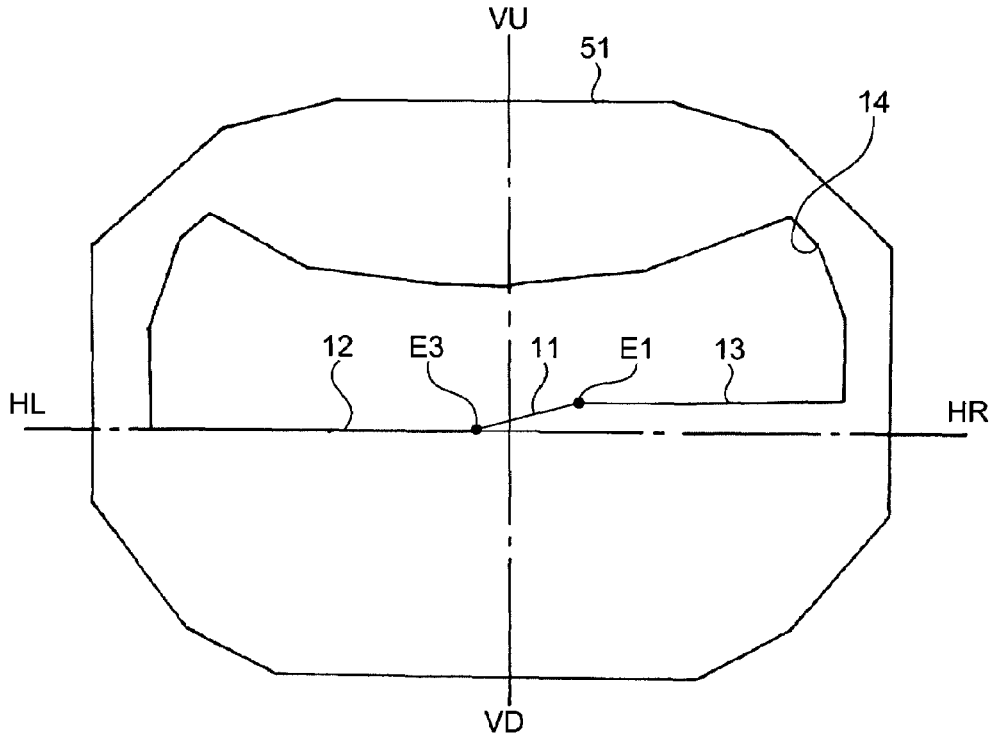
FIG. 12 is a back view of a shade according to a first modification of the embodiment.

FIG. 10 is a schematic diagram for explaining the passing-light-distribution pattern obtained with a shade 51 according to a first modification of the embodiment. In the shade 51, as shown in FIG. 12, the elbow point E1, which is the intersection of the diagonal edge 11 and the upper horizontal edge 13, is horizontally shifted rightward from the first reference position (the elbow point E10) or the vertical reference axis VU-VD, and the diagonal edge 11 is inclined at an angle less than an angle at which the reference diagonal edge (the diagonal edge 110) is inclined. On the other hand, the intersection E3 of the diagonal edge 11 and the lower horizontal edge 12 is located at the second reference position (the intersection E30) without being shifted therefrom.

As a result, as shown in FIG. 10, in the passing-light-distribution pattern obtained by the shade 51, the elbow point E2, which is the intersection of the diagonal cut-off line CL1 and the lower horizontal cut-off line CL3, is horizontally deviated leftward from the reference elbow point E20 or the vertical reference axis VU-VD, and the diagonal cut-off line CL1 is inclined at an angle less than an angle at which the reference diagonal cut-off line CL10 is inclined. On the other hand, the intersection E4 of the diagonal cut-off line CL1 and the upper horizontal cut-off line CL2 is located at the reference intersection E40 without being shifted therefrom.

Accordingly, as shown in FIG. 10, the diagonal cut-off line CL1 of the passing-light-distribution pattern obtained by the shade 51 passes substantially the end of the area IP, whereas the diagonal cut-off line CL10 of the passing-light-distribution pattern obtained by the conventional vehicle headlamp passes substantially the center of the area IP. Accordingly, the passing-light-distribution pattern obtained by the shade 51 can obtain substantially the same action and effect as those of the passing-light-distribution pattern P obtained by the shade 5.

Figure 11:
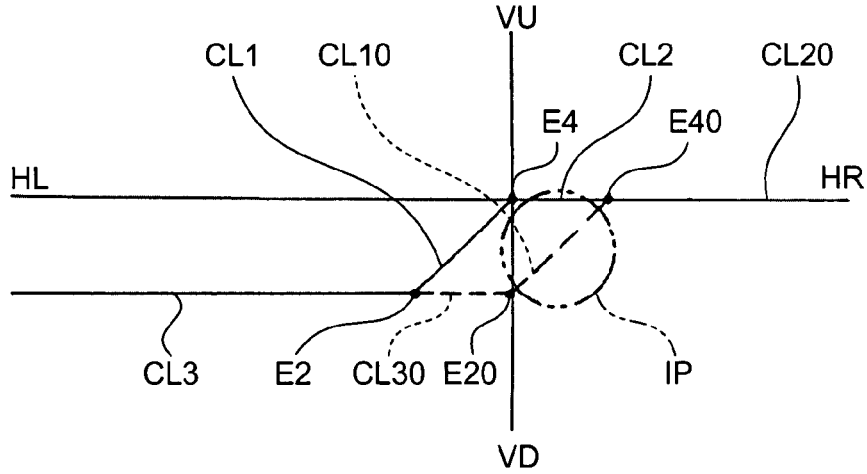
FIG. 11 is a schematic diagram for explaining a difference between cut-off lines of a passing-light-distribution pattern according to a second modification of the embodiment and the cut-off lines of the passing-light-distribution pattern of the conventional vehicle headlamp.
Figure 13:
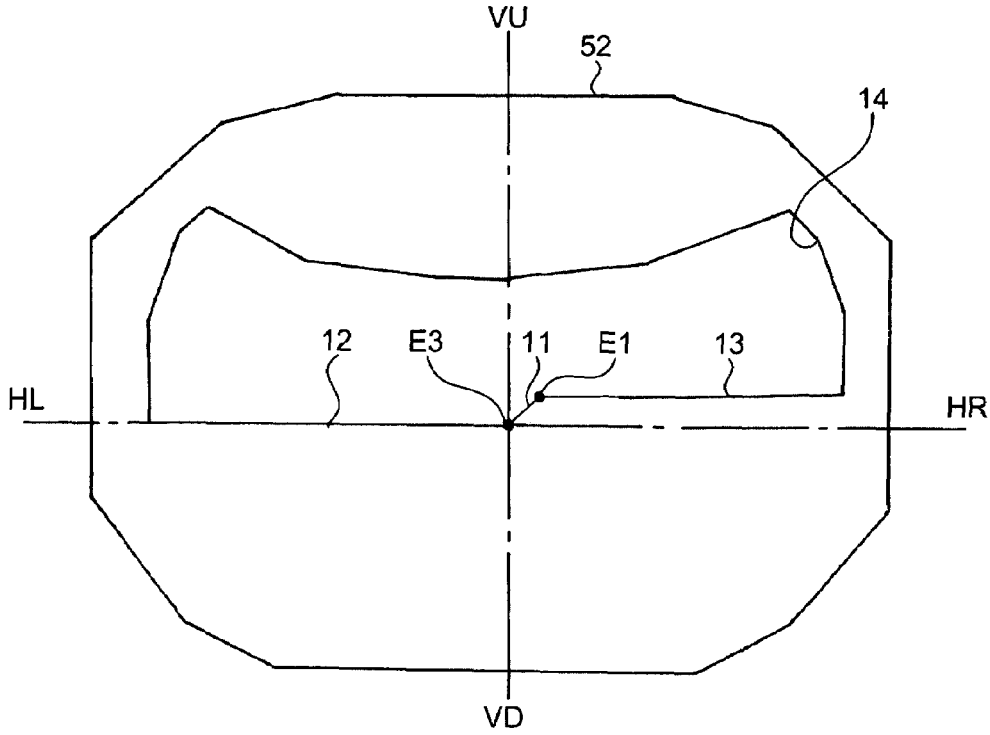
FIG. 13 is a back view of a shade according to a second modification of the embodiment.

FIG. 11 is a schematic diagram for explaining the passing-light-distribution pattern obtained with a shade 52 according to a second modification of the embodiment. In the shade 52, as shown in FIG. 13, the elbow point E1, which is the intersection of the diagonal edge 11 and the upper horizontal edge 13, is horizontally shifted rightward from the first reference position (the reference elbow point E10) or the vertical reference axis VU-VD, the intersection E3 of the diagonal cut-off line CL1 and the lower horizontal cut-off line CL3 is horizontally shifted rightward from the second reference position (the intersection E30) to the vertical reference axis VU-VD, and the inclination of the diagonal edge 11 is made substantially the same as that of the reference diagonal edge 110.

As a result, as shown in FIG. 11, in the passing-light-distribution pattern obtained by the shade 52, the elbow point E2, which is the intersection of the diagonal cut-off line CL1 and the lower horizontal cut-off line CL3, is horizontally deviated leftward from the reference elbow point E20 or the vertical reference axis VU-VD, and the intersection E4 of the diagonal cut-off line CL1 and the upper horizontal cut-off line CL2 is horizontally deviated leftward from the reference intersection E40 to the vertical reference axis VU-VD. On the other hand, the diagonal cut-off line CL1 has substantially the same inclination as that of the reference diagonal cut-off line CL10.

Accordingly, as shown in FIG. 11, the diagonal cut-off line CL1 of the passing-light-distribution pattern obtained by the shade 52 does not pass through the area IP, whereas the diagonal cut-off line CL10 of the passing-light-distribution pattern obtained by the conventional vehicle headlamp passes substantially the center of the area IP. Accordingly, the passing-light-distribution pattern obtained by the shade 52 can obtain substantially the same action and effect as those of the passing-light-distribution pattern P obtained by the shade 5.

While the vehicle headlamp is explained as a headlamp in the above embodiment, the vehicle headlamp can be lamps other than a headlamp such as fog lamps.

In the above embodiment, a projector-type headlamp that creates the passing-light-distribution pattern P having the cut-off lines CL1, CL2, and CL3 is explained. However, such vehicle headlamp is intending to include any headlamps that produce other types of light-distribution patterns. As shown in FIG. 5, examples of the light-distribution pattern include a light-distribution pattern for freeway driving having the cut-off lines CL1, CL2, and CL3 (the lower horizontal cut-off line CL2 is shown by two-dot chain line).

While the above discussion pertains principally to the case of left-hand traffic, the vehicle headlamp according to the embodiment can also be applied to the left-side traffic. In this case, the edges of the shade are left-right reversed, and the cut-off lines of the light-distribution pattern are left-right reversed.

Figure 14:
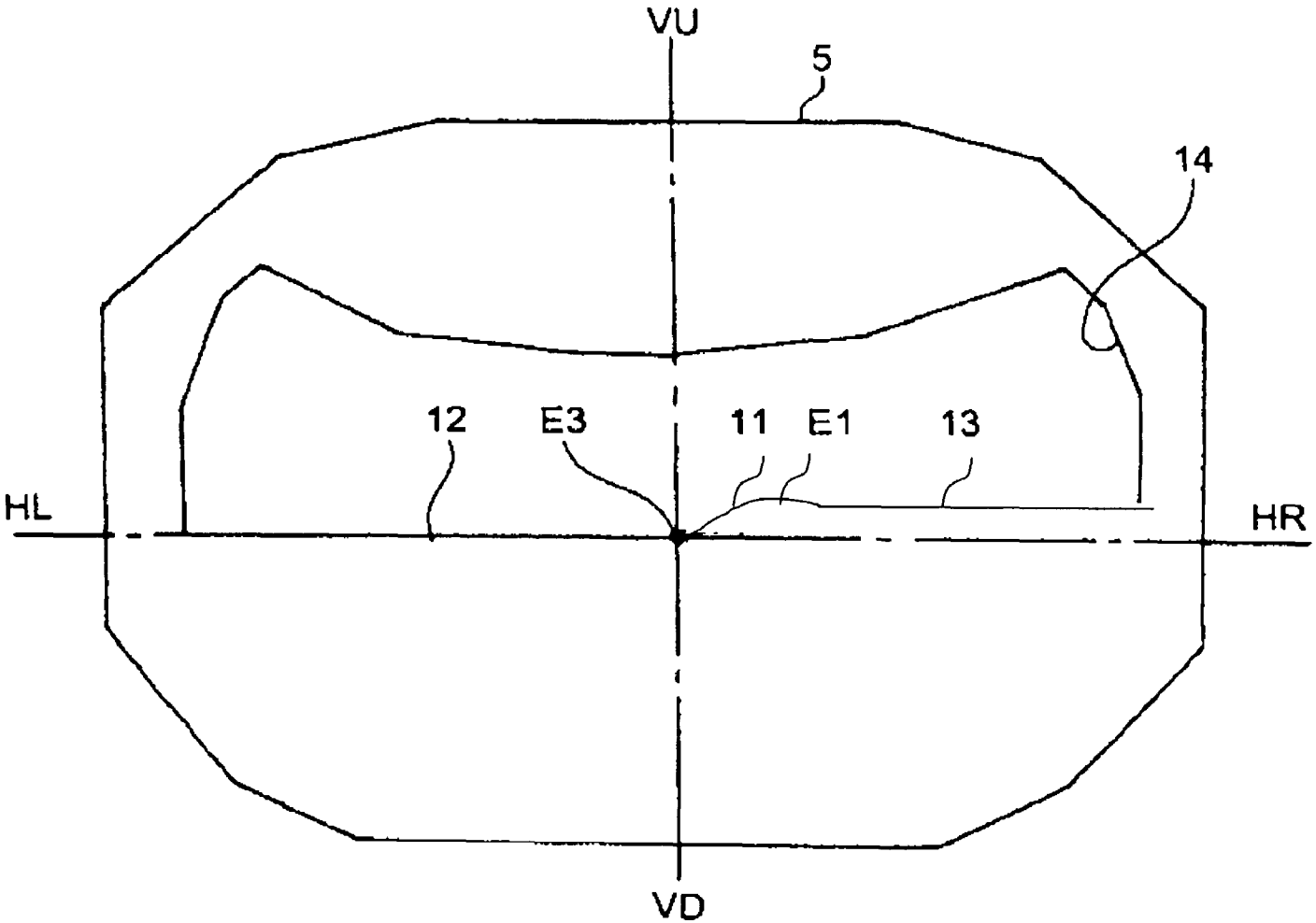
FIG. 14 is a back view of a sample according to a third modification of the embodiment.

In the above embodiment, the elbow point E1, which is the intersection of the diagonal edge 11 and the upper horizontal edge 13 of the shade 5, and the intersection E3 of the diagonal edge 11 and the lower horizontal edge 12 of the shade 5 have an obtuse angle. However, the elbow point E1 and the intersection E3 can be curved (see FIG. 14). In this case, the elbow point E2, which is the intersection of the diagonal cut-off line CL1 and the lower horizontal cut-off line CL3, and the intersection E4 of the diagonal cut-off line CL1 and the upper horizontal cut-off line CL2 are curved and rounded. Accordingly, softness and high-class feeling can be achieved in the light and shade of the passing-light-distribution pattern P.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A vehicle headlamp for illuminating front of a vehicle with light in a light-distribution pattern, the vehicle headlamp comprising:

a light source;

a reflector that reflects light from the light source;

a projection lens that projects reflected light from the reflector; and a shade that blocks part of the reflected light directed toward the projection lens from the reflector to form the light-distribution pattern having cut-off lines, wherein the cut-off lines are formed based on a vertical reference axis and a horizontal reference axis, and include a diagonal cut-off line, a first horizontal cut-off line extending horizontally from a first end of the diagonal cut-off line, and a second horizontal cut-off line extending horizontally from a second end of the diagonal cut-off line, the shade includes a diagonal edge that forms the diagonal cut-off line, a second horizontal edge that forms the first horizontal cut-off line, and a first horizontal edge that forms the second horizontal cut-off line, and a first intersection, which is an intersection of the diagonal edge and the first horizontal edge, is horizontally deviated from a first reference position, which is located on the vertical reference axis, in a direction opposite to a second intersection, which is an intersection of the diagonal edge and the second horizontal edge.

2. The vehicle headlamp according to claim 1, wherein the diagonal edge is inclined at an angle less than an angle at which a reference diagonal edge is inclined, the reference diagonal edge being obtained when the first intersection is located at the first reference position, and the second intersection is located at a second reference position, the second reference position being located on the horizontal reference axis and off the vertical reference axis in a direction opposite to the first intersection.

3. The vehicle headlamp according to claim 1, wherein the second intersection is horizontally deviated from the second reference position up to, at maximum, the vertical reference axis in a direction in which the first intersection is deviated from the first reference position.

4. The vehicle headlamp according to claim 1, wherein the diagonal edge and the first horizontal edge intersect at an obtuse angle.

5. The vehicle headlamp according to claim 1, wherein the diagonal edge and the second horizontal edge intersect at an obtuse angle.

6. The vehicle headlamp according to claim 1, wherein the first intersection is curved.

* * * * *